US006502619B1

(12) United States Patent
Kraeutler

(10) Patent No.: US 6,502,619 B1
(45) Date of Patent: Jan. 7, 2003

(54) SAFETY AND PROTECTION DEVICE FOR AN INDUSTRIAL DOOR

(75) Inventor: Bernard Kraeutler, Dunieres (FR)

(73) Assignee: Nergeco S.A., Dunieres (FR)

( * ) Notice: Subject to any disclaimer, the term of this patent is extended or adjusted under 35 U.S.C. 154(b) by 0 days.

(21) Appl. No.: 09/529,879

(22) PCT Filed: Oct. 20, 1998

(86) PCT No.: PCT/FR98/02237

§ 371 (c)(1),
(2), (4) Date: Sep. 1, 2000

(87) PCT Pub. No.: WO99/23342

PCT Pub. Date: May 14, 1999

(30) Foreign Application Priority Data

Oct. 31, 1997 (FR) ..... 97 13683

(51) Int. Cl.[7] ..... A47H 5/00
(52) U.S. Cl. ..... 160/84.01; 160/84.04
(58) Field of Search ..... 160/84.01, 84.04, 160/84.06, 84.11, 124, 264, 348; 296/100.01, 181

(56) References Cited

U.S. PATENT DOCUMENTS 4,700,985 A * 10/1987 Whitehead ..... 296/181
4,824,505 A * 4/1989 Kraeutler ..... 156/227
5,072,767 A * 12/1991 Kraeutler ..... 160/84.01
5,273,096 A * 12/1993 Thomsen et al. ..... 160/84.01
5,547,006 A * 8/1996 Auger ..... 160/84.01
5,566,734 A * 10/1996 Levy et al. ..... 160/84.04
5,566,735 A * 10/1996 Jelic ..... 160/84.04
5,690,156 A * 11/1997 Ruggles ..... 160/84.04
5,862,850 A * 1/1999 Yang ..... 160/84.04
6,116,319 A * 9/2000 Simon ..... 160/84.01
6,257,300 B1 * 7/2001 Brownlie ..... 160/84.01

FOREIGN PATENT DOCUMENTS

| | | |
|---|---|---|
| CH | 523 394 | 5/1972 |
| FR | 2 274 775 | 1/1976 |
| FR | 2 614 924 | 11/1988 |

* cited by examiner

*Primary Examiner*—Bruce A. Lev
(74) *Attorney, Agent, or Firm*—Sughrue Mion, PLLC

(57) ABSTRACT

A safety and protection device for a raisable-curtain goods-handling door (1) has a flexible curtain including a single sheet fitted with at least one raising strap (10) disposed against the outside of the curtain, the device having an apron (7) placed against the curtain on the same face of the curtain as the straps, to cover the door from the vicinity of its bottom up to a height that is at least sufficient to provide the desired type of protection, and over a width that is at least sufficient to cover the straps, the apron being capable of being fixed to the curtain in such a manner as to avoid impeding the movements of the strap.

8 Claims, 2 Drawing Sheets

SAFETY AND PROTECTION DEVICE FOR AN INDUSTRIAL DOOR

BACKGROUND OF THE INVENTION

The present invention relates to a safety and protection device for an industrial and/or goods-handling door of the raisable type and that is provided with at least one strap placed against the door.

Industrial and/or goods-handling doors are doors installed in factories, warehouses, all kinds of hangar, supermarkets, public places, etc. for separating spaces and workshops from one another or for isolating them from the outside so as to maintain temperature, avoid propagating drafts, noise, etc. Raisable doors are organized to be opened and then reclosed quickly by being raised and lowered so as to allow people or vehicles of any kind such as trucks, carts, etc. to pass through. These doors are constituted by curtains made up of flexible or rigid panels that are rolled up or that are folded up at the top of the door. Fold-up doors are actuated by straps which lift the panels. Roll-up doors do not use straps for operating purposes, but they can have straps for special functions: detecting obstacles, monitoring tension in the curtain, consolidation, etc.

A strap is constituted by a cable or tape made of textile or other material that is strong and capable of being rolled up on a suitable drum. An object of the invention is to protect straps against accidentally catching on equipment that is traveling too close to the door, or to prevent them from catching on people located too close to the door, since that could be dangerous for such people.

Certain fold-up doors, such as those described in the following publications: CH-A-523 394, FR-A-2 274 775, and FR-A-2 614 924, describe doors each comprising a curtain constituted by two flexible vertical sheets that are parallel and connected together at the bottom of the curtain and at various heights by horizontal stiffener elements. Traction members for raising the curtain, such as straps, are disposed between the two sheets. They are connected to the bottom stiffener, and they pass through holes formed in the other stiffeners. In curtains of that type, the straps are located internally. They cannot be damaged by equipment traveling too close to the door, nor can they catch onto such equipment or onto people located too close to the door.

Nevertheless, there exist very many types of door in which the straps are disposed against one of the faces of the curtains. Such doors are less expensive. However they suffer from those above-mentioned drawbacks: firstly they run the risk of catching on any equipment projecting from a truck or a cart, thereby causing the straps to be damaged or even cut or broken. They can also be damaged deliberately by vandals. Secondly, any person or equipment passing too close, or happening to be location against the door, can be caught by the strap and lifted when the curtain is raised. Curtain raising can be completely unexpected since it can be triggered by a truck approaching the door from the other side. This can rise give to serious accidents, unless some kind of prevention or protection is provided of electrical, mechanical, physical, or other type.

An object of the invention is to remedy those drawbacks and to eliminate such risks with the latter type of door.

SUMMARY OF THE INVENTION

The present invention provides a safety and protection device for a raisable-curtain goods-handling door comprising a flexible curtain constituted by a single sheet fitted with at least one raising strap disposed in removable manner against the outside of the curtain, the device being characterized in that it is constituted by an apron designed to be placed against the curtain on the same face of the curtain as the straps, to cover the door from the vicinity of its bottom up to a height that is at least sufficient to provide the desired type of protection, and over a width that is at least sufficient to cover the straps, the apron being capable of being fixed to the curtain in such a manner as to avoid impeding the movements of the strap.

Advantageously, the apron fixing means are selected so as to enable the apron to be removed and put back into place simply and quickly.

The apron can be fixed to the curtain by fasteners including any of: press studs; zip fasteners; strips of hook-and-loop fasteners; snap-fasteners; screws; and the like.

In an embodiment where the curtain of the door is reinforced by at least one horizontal stiffening bar, the apron also has a number of bars corresponding to the number of bars in the curtain over the height that it covers. The bars of the apron are simply attached to the bars of the curtain. If the curtain has a sheath for each bar, the sheath being formed with a cutout to receive a piece for passing the strap, then the apron has a sheath for receiving the corresponding bar, said sheath including a cutout for putting in register with the cutout in the sheath of the curtain, the bar of the apron as uncovered in this way being capable of being attached to said piece for passing the strap by any appropriate attachment means.

Other characteristics and advantages of the invention appear from the following description given with reference to the accompanying drawings, serving to make it well understood how the invention can be implemented.

BRIEF DESCRIPTION OF THE DRAWING FIGURES

DETAILED DESCRIPTION OF THE INVENTION

An apron of the invention can be fixed simply to the curtain against the flexible curtain itself, preferably by means that are simple to do and undo: press studs; zip fasteners; fasteners of the Velcro type (registered trademark); snap-fastening means; screws; or the like. Since the apron is placed against the curtain on its side where it has at least one strap, it is essential to allow the strap to move by placing the attachment means correctly, but that does not present any difficulty for the person skilled in the art.

For a fold-up curtain that is reinforced by stiffening bars, the curtain folds along the bars, or along some of them (e.g. every other bar). It can then be advantageous to make the apron with its own stiffening bars, which are fixed to the stiffening bars of the curtain. It is also possible to make the apron without any stiffening bars. Examples are described below.

Figure 1A:
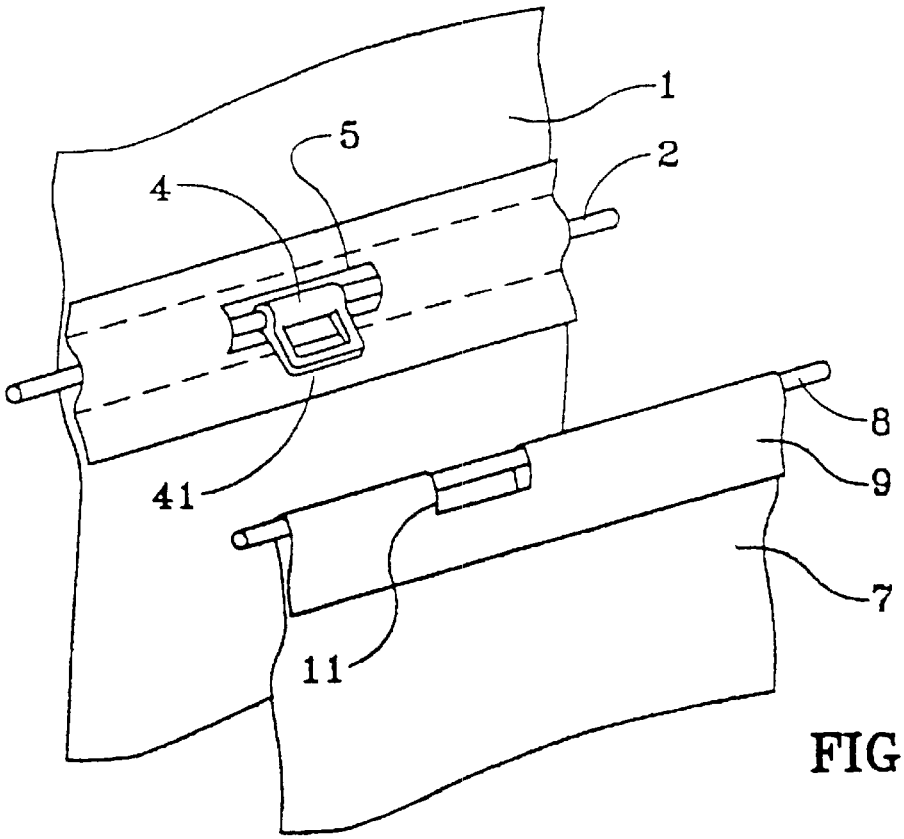
FIG. 1A is a fragmentary perspective view showing part of a curtain reinforced by stiffening bars received in sheaths, together with part of an apron in register therewith and constituted by a sheet reinforced by bars that are likewise received in sheaths.

FIG. 1A is a perspective view of a portion of the curtain 1 of a fold-up door which is reinforced by a bar 2 received in a sheath 3 which is formed, by way of example, by fitting a strip of suitable sheet material which is stuck, welded, or sewn to the curtain. In such a curtain, in order to guide the strap, strap-guides 4 are engaged on the bar, and each strap-guide is located in an opening 5 formed through the sheath. A well known type of strap-guide is in the form of a D-shape having a handle portion 41. The strap 10 (FIG. 2) passes through the D-shape and the curtain operates in well known manner. The apron of the invention is itself constituted by a sheet 7 of suitable material, transparent if so required, thereby making it possible to see the curtain and the strap that it protects. The apron is reinforced by bars 8 which are received in sheaths 9 at the same spacing as the reinforcing bars of the curtain. Cutouts 11 are formed in the sheaths of the apron in register with the cutouts formed in the sheaths of the curtain for the strap-guides. It is then simple to fix the bars of the apron to the D-shapes 44 of the strap-guides, by any type of commercially-available attachment 12 (see FIG. 2). In this example, it can be seen that an apron of the invention can be placed on a door of this type without requiring the slightest modification to be made to the door.

Figure 1B:
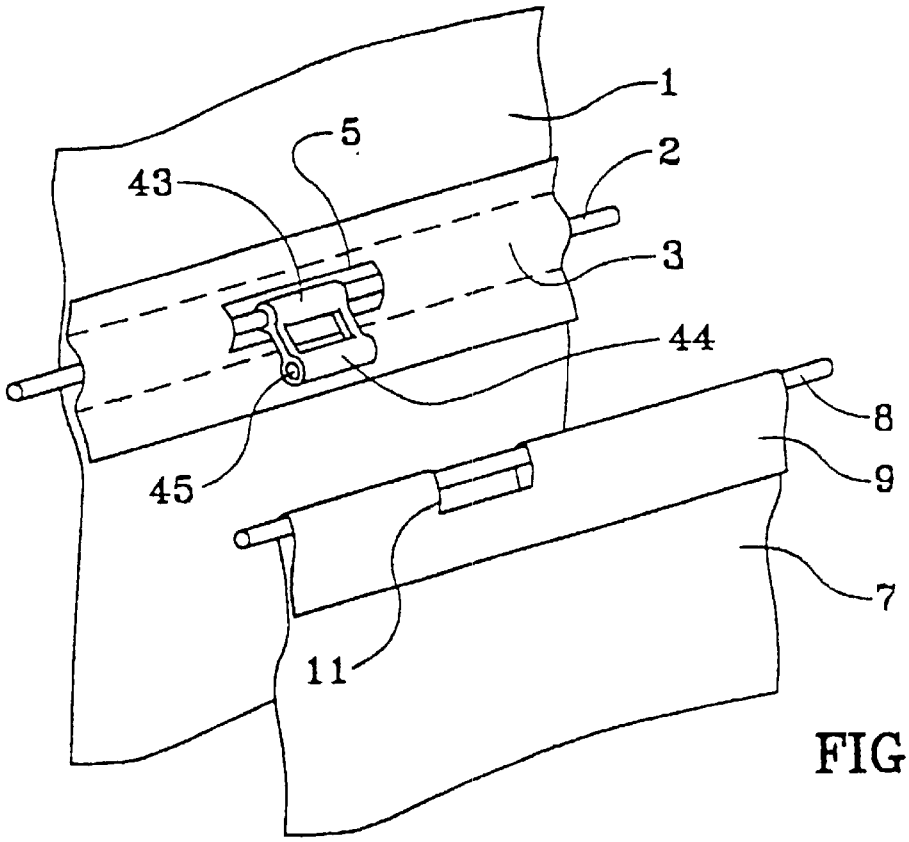
FIG. 1B shows a variant of the device of FIG. 1A in which a special piece is provided for attaching the apron to the curtain.

The fixing of FIG. 1B is obtained by means of a strap-guide 43 whose D-shape 44 is formed to have a portion that constitutes a tube 45. The assembly made up in this way is simple, reliable, and pleasing in appearance.

Figure 2:
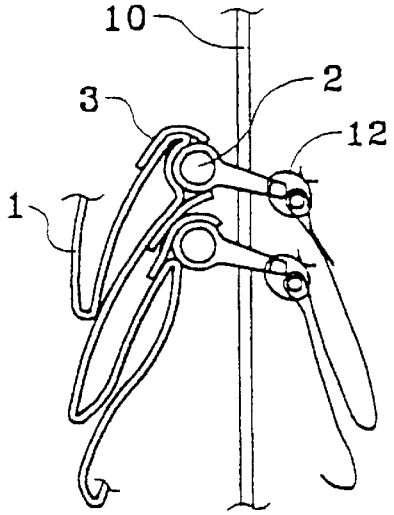
FIG. 2 is a section view through a curtain of the type shown in FIG. 1, provided with an apron of the type shown in FIG. 1, and shows, in the folded state, a segment of the curtain extending between two reinforcing bars.

FIG. 2 is a section on a vertical plane perpendicular to the curtain through the middle of a strap-guide, with the curtain being shown in its raised and folded-up position after an apron has been fixed to the curtain in the manner described above with reference to FIG. 1A. The folds of the curtain fall on one side of the strap (to the left in the figure), while the folds of the apron fall to the other side thereof. It will be observed that by being present the apron not only protects the strap, but also serves to prevent any object or arm (e.g. belonging to a person leaning against the curtain) from being trapped and drawn into a fold of the curtain.

The apron is advantageously put into place starting from the bottom of the curtain and extending up to a desired height, e.g. about 2 meters so as to protect people. It could extend higher, for example if there is a risk of catching on a fork of a forklift truck at some greater height. In terms of width, it is preferable for the apron to extend between the uprights of the door without it being necessary for it to penetrate therein, unless that should be of some special use in a particular application.

It will be understood that such an apron can be delivered with a new door, or can be installed on any existing door. The invention makes it possible to obtain a high level of safety with means that are simple. The apron also provides simultaneously improved sound and heat insulation. To this end, a door can be fitted with an apron that covers the entire surface area of the door, e.g. in winter.

Figure 3:
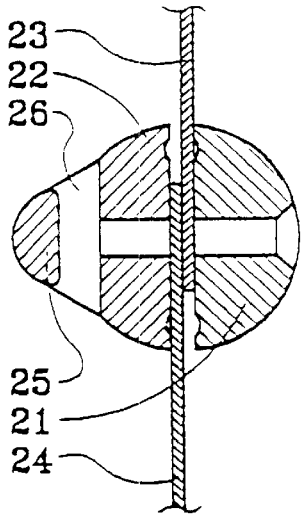
FIG. 3 is a section view through a portion of door curtain with a reinforcing bar that is fixed to the curtain without using a sheath, being of the type described in the Applicant's European patent No. 0 551 784.

FIG. 3 is a section view on a vertical plane perpendicular to the door through a strap for a door of the type described in European patent No. 0 551 784. Each bar is made up of two half-bars 21 and 22 pressed one against the other and clamping the curtain between them. In this example, the curtain is made up of a plurality of panels 23, 24 whose overlapping edges are clamped together between pairs of half-bars. Each bar has portions of greater thickness 25 located in suitable positions, and where appropriate over its entire length, and pierced by channels 26 for passing respective straps. In this example, it suffices to fix the apron to the portions of extra thickness 25, e.g. by means of press studs. The apron should not have reinforcing bars. Nevertheless, if the number of portions of extra thickness 25 is not sufficient, then it is preferable to provide fixing bars.

Figure 4:
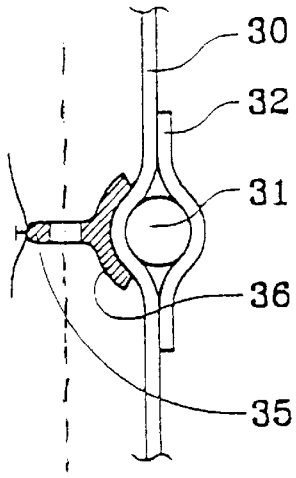
FIG. 4 is a view analogous to FIG. 3 for showing Another type of curtain reinforcing bar.

Another example is shown in FIG. 4 which is likewise a section view on a vertical plane perpendicular to a fold-up curtain 30 and passing through the fixing for a strap-guide. The reinforcing bar 31 is received in a sheath formed with a strip 32 suitably fixed to the curtain 30.

The sheath is not opened for the purpose of fixing a strap-guide. Each strap-guide is in the form of a D-shape 35 secured to a half-sleeve 36. The half-sleeve is fixed to the bar 31 through the curtain 30. The apron can then be fixed to the D-shape 35, with or without its own fixing bar, depending on circumstances.

The apron can be fixed to a part other than a strap-guide that is already in place. It is possible to use any number of analogous parts that are not used to guide straps and that are placed along the bar.

The device of the invention is simple and low cost to make and install. It can also be used (e.g. in winter) to seal screens that are pierced with ventilation holes, such as anti-wear screens, for example. Easy installation and removal enable the apron to be put into place quickly, and also to be removed for the purpose of access, adaptation, etc.

What is claimed is:

1. A safety and protection device for a raisable curtain door, comprising:

a flexible curtain constituted by a single sheet fitted with at least one raising strap disposed against an outside face of the flexible curtain and having at least one first horizontal stiffening bar received in at least one first sheath, the at least one first sheath having at least one first cutout for receiving a strap-passing part; and an apron covering the flexible curtain from a vicinity of a bottom of the flexible curtain up to a height that provides a desired amount of protection for the at least one raising strap, and over a width that is at least sufficient to cover the at least one raising strap, the apron having at least one second horizontal stiffening bar, the at least one second horizontal stiffening bar being attached to the strap-passing part by a fastening assembly at an uncovered portion provided by the at least one first cutout.

2. The safety and protection device of claim 1, wherein the fastening assembly is configured to attach the apron to the flexible curtain; and wherein the fastening assembly is configured to remove the apron from the flexible curtain.

3. The safety and protection device of claim 1, wherein the fastening assembly comprises at least one of press studs, zip fasteners, strips of hook-and-loop fasteners, snap-fasteners, and screws.

4. The safety and protection device of claim 1, wherein the fastening assembly is fixed to the at least one second horizontal bar, and wherein the fastening assembly is configured to fix the at least one second horizontal bar to the at least one first horizontal bar.

5. The safety and protection device of claim 1, wherein the apron has at least one second sheath configured to receive the at least one second horizontal bar, the at least one second sheath having at least one second cutout to uncover a portion of the second horizontal bar; and wherein the at least one second cutout is placed in register with the at least one first cutout to facilitate attaching the at least one second horizontal bar to the strap-passing part by the fastening assembly.

6. The safety and protection device of claim 1, wherein the at least one first horizontal stiffening bar has means for retaining and passing the at least one raising strap; and wherein the apron is fixed to the means for retaining and passing the at least one raising strap.

7. The safety and protection device of claim 6, wherein the at least one second horizontal stiffening bar is fixed to the means for retaining and passing the at least one raising strap.

8. A goods-handling door provided with the safety and protection device of claim 1.

* * * * *